US006646548B2

(12) United States Patent
Dornfeld

(10) Patent No.: US 6,646,548 B2
(45) Date of Patent: Nov. 11, 2003

(54) ELECTRONIC SIREN

(75) Inventor: David P. Dornfeld, Killingworth, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 400 days.

(21) Appl. No.: 09/757,346

(22) Filed: Jan. 9, 2001

(65) Prior Publication Data

US 2002/0089416 A1 Jul. 11, 2002

(51) Int. Cl.[7] ..... G08B 3/10

(52) U.S. Cl. ..... 340/384.4; 340/384.1; 340/384.5

(58) Field of Search ..... 340/384.1, 384.3, 340/384.4, 384.5, 474, 384.6, 384.7, 384.71

(56) References Cited

U.S. PATENT DOCUMENTS 4,287,510 A * 9/1981 Siegwarth ..... 340/384.72
4,625,206 A * 11/1986 Jensen ..... 340/902
4,796,009 A * 1/1989 Biersach ..... 340/388.4
4,806,931 A * 2/1989 Nelson ..... 340/907
5,278,537 A * 1/1994 Carlo et al. ..... 340/384.1
5,390,360 A * 2/1995 Scop et al. ..... 455/516
5,609,507 A * 3/1997 Spector ..... 446/72
5,754,095 A * 5/1998 Bader ..... 340/384.7
5,816,886 A * 10/1998 Cusolito ..... 446/444
6,184,779 B1 * 2/2001 Chen ..... 340/425.5

* cited by examiner

*Primary Examiner*—Daryl Pope
(74) *Attorney, Agent, or Firm*—Alix, Yale & Ristas, LLP

(57) ABSTRACT

An electronic siren emulates the sound of a mechanical siren using a dynamic algorithm and look up tables to generate a series of wave sets, each wave set including one fixed frequency wave and one variable frequency wave. A micro controller stores the algorithm and look up tables and executes the algorithm on command to produce a digital output emulating the mechanical siren. The digital output is converted to an analog signal that is applied to a class D amplifier. A switching power supply provides 70 VDC to the output stage of the amplifier. This arrangement produces 126 dB of sound pressure at a distance of 10 feet from the reverse folded horn speaker. The electronic siren generates little heat and requires only 10 amps of current from the vehicle electrical system.

20 Claims, 16 Drawing Sheets

Output Ramping Down $t_1$=.002s
$a_1$=500Hz $t_2$=.0005s
$a_2$=200Hz $t_3$=.001s
$a_3$=1000Hz

ELECTRONIC SIREN

BACKGROUND OF THE INVENTION

1. Field of the Invention

This invention relates generally to sirens for emergency vehicles. More particularly, this invention relates to electronic sirens that are used in vehicles to form a wide variety of audio warnings.

2. Description of the Related Art

Emergency vehicles such as fire trucks conventionally use a mechanical siren which sweeps up and down the frequency range (from low pitch, low frequency sound output to high pitch high frequency sound output) to generate a traditional warning which is readily perceptible and recognizable. The siren may also be accompanied by bells and horns to supplement the warning. The pitch of the sound generated by a mechanical siren increases (toward a maximum high frequency pitch) with the rotational speed of the internal rotor. Typically, a switch applies power to the siren drive motor that spins the siren rotor at an increasing speed until a maximum speed is reached. A mechanical siren may take as long as 20 to 30 seconds to achieve maximum speed and thus maximum pitch. When power is removed from the siren drive motor, the siren rotor slows down over time. The pitch of the siren decreases as the rotor slows down. The mechanical siren may also include a brake for rapidly stopping the rotor. Such brakes function similarly to a disc brake in a car and are subject to the same wear and maintenance problems as the rest of the siren assembly. The siren operator in the emergency vehicle controls the up-down sweep of the siren by intermittently closing and opening the switch and/or applying the brake.

While the traditional mechanical siren has functioned well over the years, it is subject to well-known limitations. For example, the mechanical siren is prone to high maintenance because the motor, drive train, brake and bearings wear over time. Mechanical siren sound patterns vary from unit to unit and may vary over time. Additionally, the current draw from a mechanical siren can exceed 100 amps, particularly at startup.

There have recently been attempts to replace the traditional mechanical siren with an electronic siren. Such electronic sirens, which may essentially be a digital recording coupled to an amplifier, require significant power and accordingly place severe demands on the vehicle electrical system. For example, some electronic sirens draw over 30 amps. In addition, the gradually increasing and decreasing pitch pattern produced by a user-actuated mechanical siren is difficult to capture. A digital recording limits the user to playing all, part or repeating parts of the recorded sound pattern. Also, such a recording results in a relatively large digital file, requiring a correspondingly large and thus costly memory capability for storage.

SUMMARY OF THE INVENTION

Briefly stated, the invention is a new and improved electronic siren that emulates a mechanical siren by employing a program executed in a micro controller to reproduce the sound patterns produced by a mechanical siren. The program uses timers and look up tables to assemble a digital output having variable frequency, amplitude and harmonic characteristics. A digital to analog (D/A) converter is used to convert the digital output into an analog waveform.

The waveform is then supplied to a Class D amplifier cooperatively linked with a switching power supply and a speaker to provide a reliable solid state system that very closely mimics the volume, harmonic content and sound pattern of a mechanical siren. The efficiency of the switching power supply/class D amplifier combination allows the electronic siren to generate 126 dB of sound pressure at a distance of 10 feet from the reverse folded horn speaker at a current draw of only 10 amps. The micro controller contains programs for generating a number of other selected sounds, including an air horn, a bell, a yelp and a high frequency tone. The electronic siren is configured to selectively receive and amplify the vehicle radio audio signal and may also be equipped with a microphone for use as a public address system.

An object of the invention is to provide a new and improved electronic siren that closely emulates substantially all the sound characteristics of a mechanical siren.

Another object of the invention is to provide a new and improved electronic siren that can generate the necessary sound pressure while demanding relatively little current from the vehicle electrical system.

A further object of the invention is to provide a new and improved electronic siren that has an efficient solid state construction and is adaptable to provide a wide variety of warning sounds.

Other objects and advantages of the invention will become apparent from the specification and the drawings.

DETAILED DESCRIPTION OF THE PREFERRED EMBODIMENT

With reference to the drawings, wherein like numerals represent like parts throughout the several figures, an electronic siren in accordance with the present invention is generally designated by the numeral 10. The electronic siren 10 is especially adapted for use in an emergency vehicle, such as a fire truck, to emulate the sound of a mechanical siren as well as to provide multiple emergency sound amplification capabilities.

Figure 2:
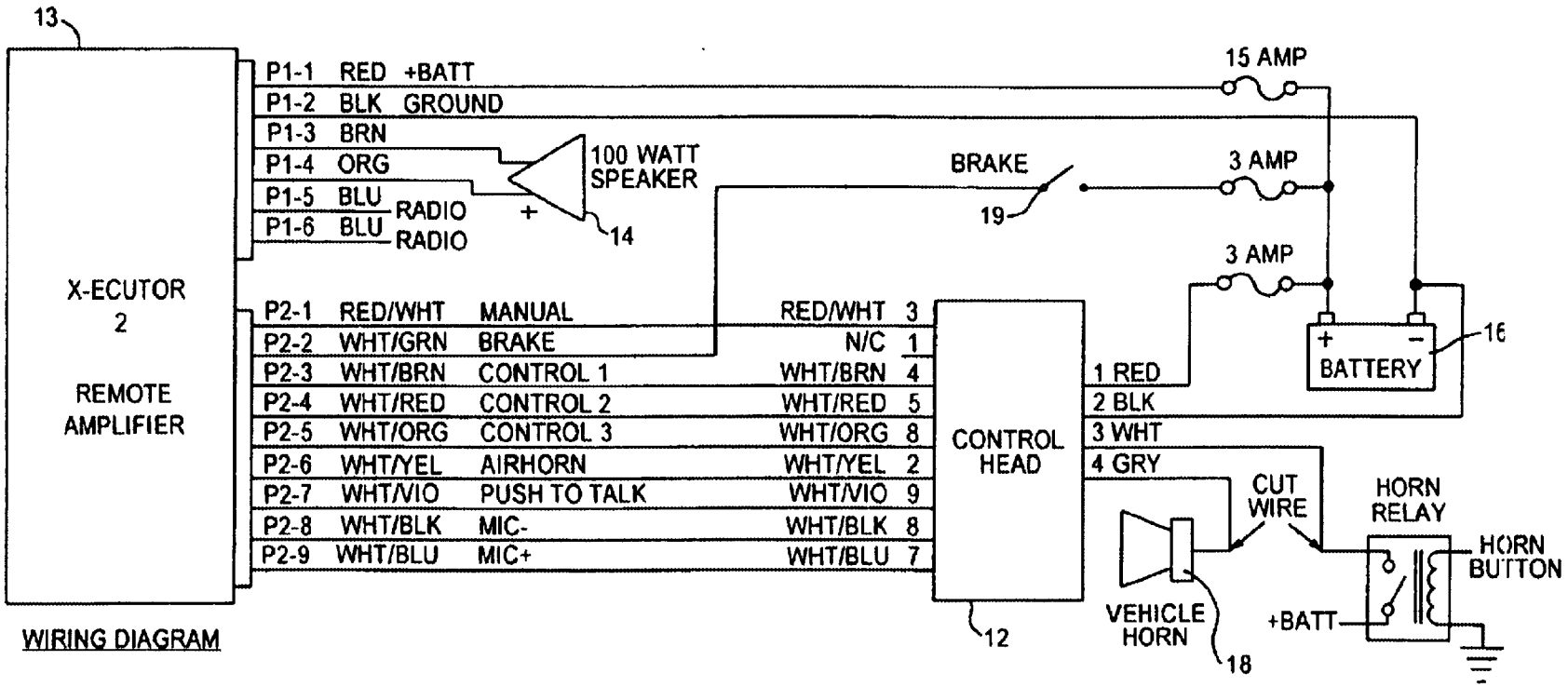
FIG. 2 is a wiring diagram for the electronic siren as incorporated into a vehicular application.
Figure 3:
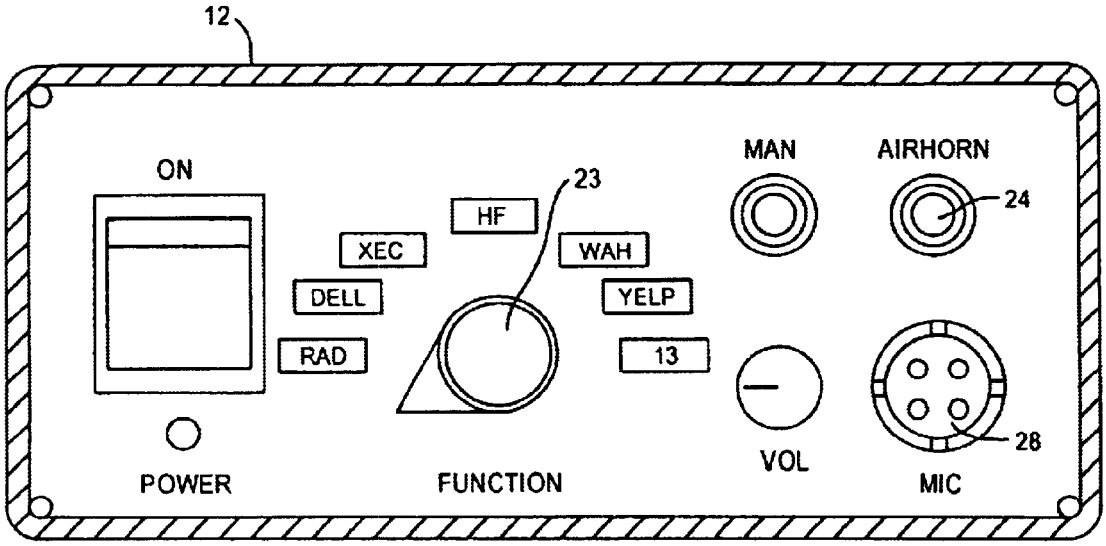
FIG. 3 is a front view of a control head for the electronic siren of FIG. 1.
Figure 4:
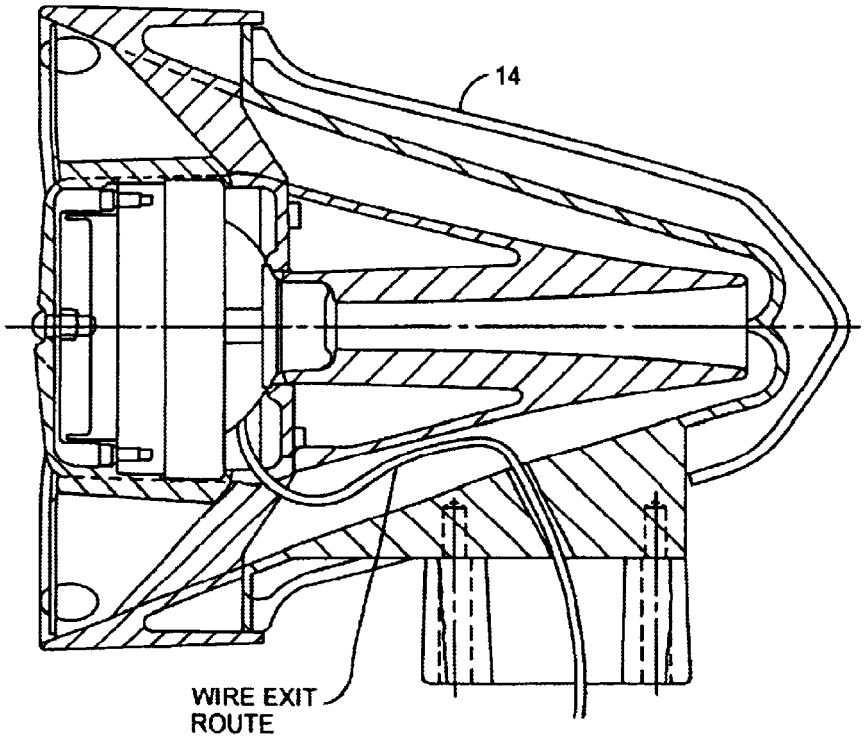
FIG. 4 is a side sectional view of a preferred speaker employed in connection with the electronic siren of FIG. 1.

With reference to FIGS. 2 and 3, the electronic siren is controlled by a compact control head 12 mounted for ready access in the vehicle cab. The control head 12 communicates with a remote amplifier 13 mounted elsewhere in the vehicle. This arrangement conserves space in the vehicle cab which, in emergency vehicles, must contain number of other systems. The remote amplifier 13 drives a 100-watt speaker 14 mounted to the exterior of the vehicle. The speaker 14 is preferably a reverse folded horn such as shown in FIG. 4. The control head 12 and remote amplifier 13 are connected to the vehicle power supply 16. The electronic siren 10 is configured to place a relatively low current demand on the vehicle electrical system 16, particularly when compared to conventional mechanical and prior art electronic sirens. The preferred embodiment of the electronic siren 10, for example, uses a current of 10 amps to produce a 126 db sound pressure at a distance of 10 feet from the speaker.

As illustrated in FIG. 3, a dial 23 on the control head 12 permits selection from among the several output capabilities of the electronic siren, such as radio repeat, bell, mechanical siren, hands free sequence, wail, yelp and a selected alternative tone. The control head may also include an air horn button 24 for activating a simulated air horn tone as well as a microphone outlet 28. A microphone (not illustrated) connected to the microphone outlet 28 permits the electronic siren to function as a public address device. The vehicle radio (not illustrated) audio output can be tied into the electronic siren 10 and amplified through the speaker 14.

Figure 1:
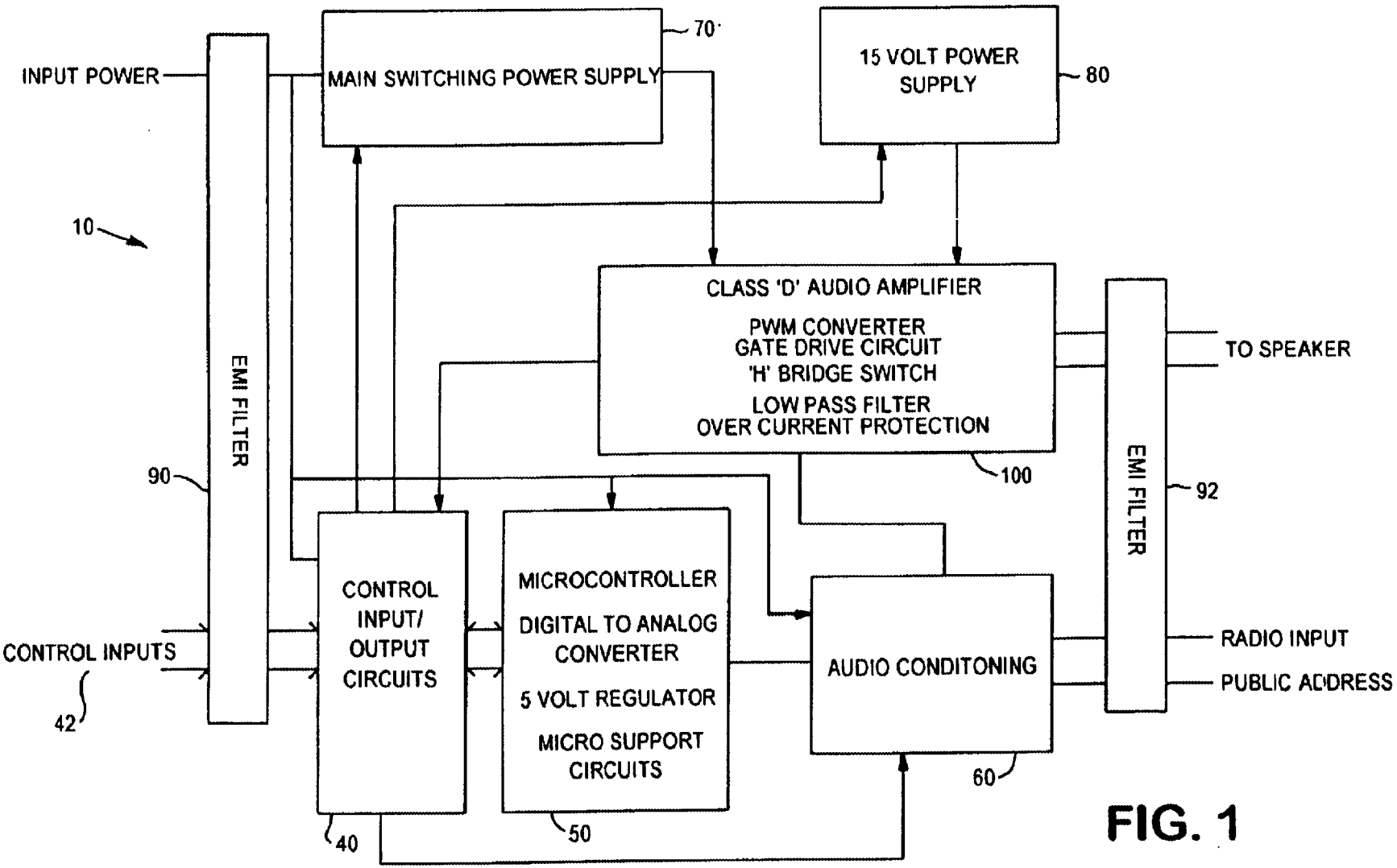
FIG. 1 is a functional block diagram of the electronic siren of the present invention.

FIG. 1 is a functional block diagram illustrating the basic components of the electronic siren 10. A control input/output circuit is responsive to control inputs 42. The control input/output circuit 40 communicates the operational status (on/off, PA volume) and selected function to a micro controller circuit 50. The micro controller turns on the necessary system components, initializes any necessary programming and, if necessary, provides a digital signal to a digital to analog (D/A) converter. The D/A converter transmits the signal to an audio conditioning circuit 60. The audio conditioning circuit 60 prepares the signal from the D/A converter for amplification. The audio conditioning circuit 60 also includes analog multiplexers that selectively allow other signals, such as the vehicle radio audio signal, to be sent to the audio amplifier 100. The audio amplifier 100 is a class D amplifier that is provided with voltage from a switching power supply 70. A regulated 15 VDC power supply 80 also provides voltage to the audio amplifier 100. Electromagnetic interference (EMI) filters 90, 92 are provided to protect the electronic siren circuitry from interference present in the vehicle electrical system and to protect the vehicle electrical system, in particular radio systems, from radio frequency (RF) noise generated by the class D amplifier 100 and switching power supply 70.

FIG. 2 is a wiring diagram illustrating a possible installed configuration for the control head 12, remote amplifier 13 and speaker 14 with respect to the vehicle electrical system 16. Vehicle horn 18 actuation may be used to trigger a hands free sequence through the control head 12. Fused vehicle power is provided to the remote amplifier 13 and the control head 12. Both the control head and remote amplifier are attached to the vehicle ground. Vehicles formerly equipped with mechanical sirens are often equipped with a siren brake switch 19 positioned for foot or hand operation. If the vehicle is not so equipped, a new switch can be installed to provide a siren brake signal BRAKE to the electronic siren. The BRAKE signal is used by the electronic siren to initiate a rapid decrease in frequency and amplitude of the siren tone to simulate the action of a mechanical siren brake.

Figure 6:
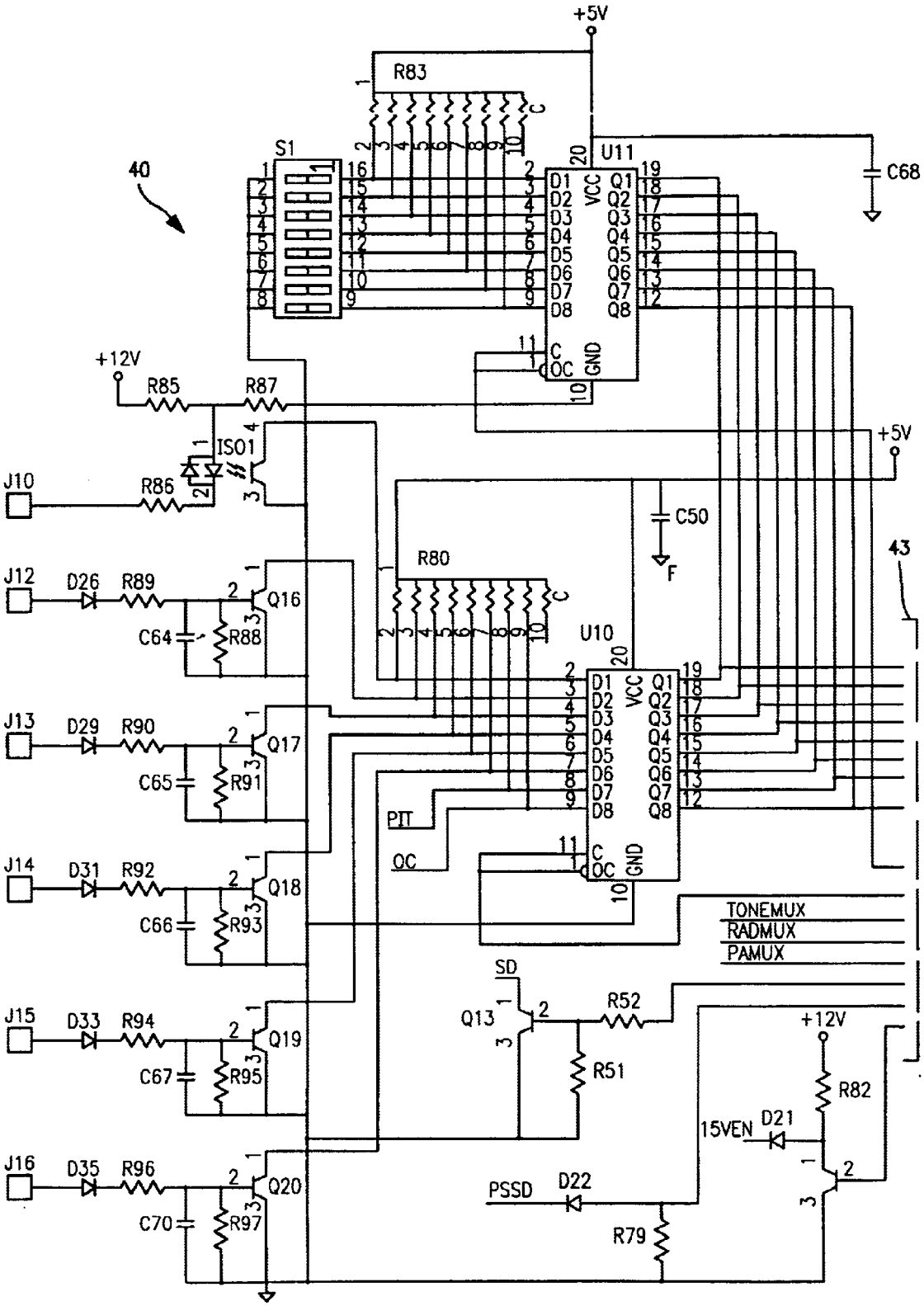
FIG. 6 is an enlarged schematic diagram of the control input/output for the electronic siren of FIG. 1.

With reference to FIG. 6, the control input/output circuit 40 responds to switches in the control head 12, a foot pedal switch (not illustrated) and/or other switches supplied by the user and produces a logic level output signal compatible with the micro controller. Input connections J12–J16 are each provided with a transistor circuit Q15–Q20. The transistor circuits Q15–Q20 convert vehicle voltage to a logic level input to an 8 bit tri-state latch integrated circuit. Each transistor circuit Q15–Q20 contains a diode D26, D29, D31, D33 and D35 to prevent reverse polarity and a capacitor C64–C70 to filter electro magnetic interference (EMI) and transient noise. Resistors R89–R95 limit the current applied to the transistors Q15–Q20. Pull down resistors R88, 91, 93, 95 and 97 prevent the voltage on signal lines J12–J16 from floating as is known in the art.

The input/output circuit 40 includes a further 8 bit tri-state latch U11. The tri-state latches U10, U11, in conjunction with a set of 8 DIP switches S1 (tied to ground), provide a multiplexed output to the micro controller U8. An opto-isolator ISO1 provides a bi-directional input receptive to vehicle voltage or ground signals. Signal lines 43 provide signal paths to and from the micro control circuit 50. Signals 15 VEN, PSSD and SD are generated by the micro control circuit 50 to turn on the 15 volt power supply 80, switching power supply 70 and the audio amplifier 100 respectively. Signals TONEMUX, RADMUX and PAMUX are generated by the micro control circuit to turn on analog multiplexers in the audio conditioning circuit 60 (see FIG. 7).

It should be apparent to one of ordinary skill in the art that the particular configuration of the input/output circuit may be modified. Any arrangement that provides appropriate logic level inputs to the micro controller U8 can replace the illustrated input/output circuit 40.

Figure 5:
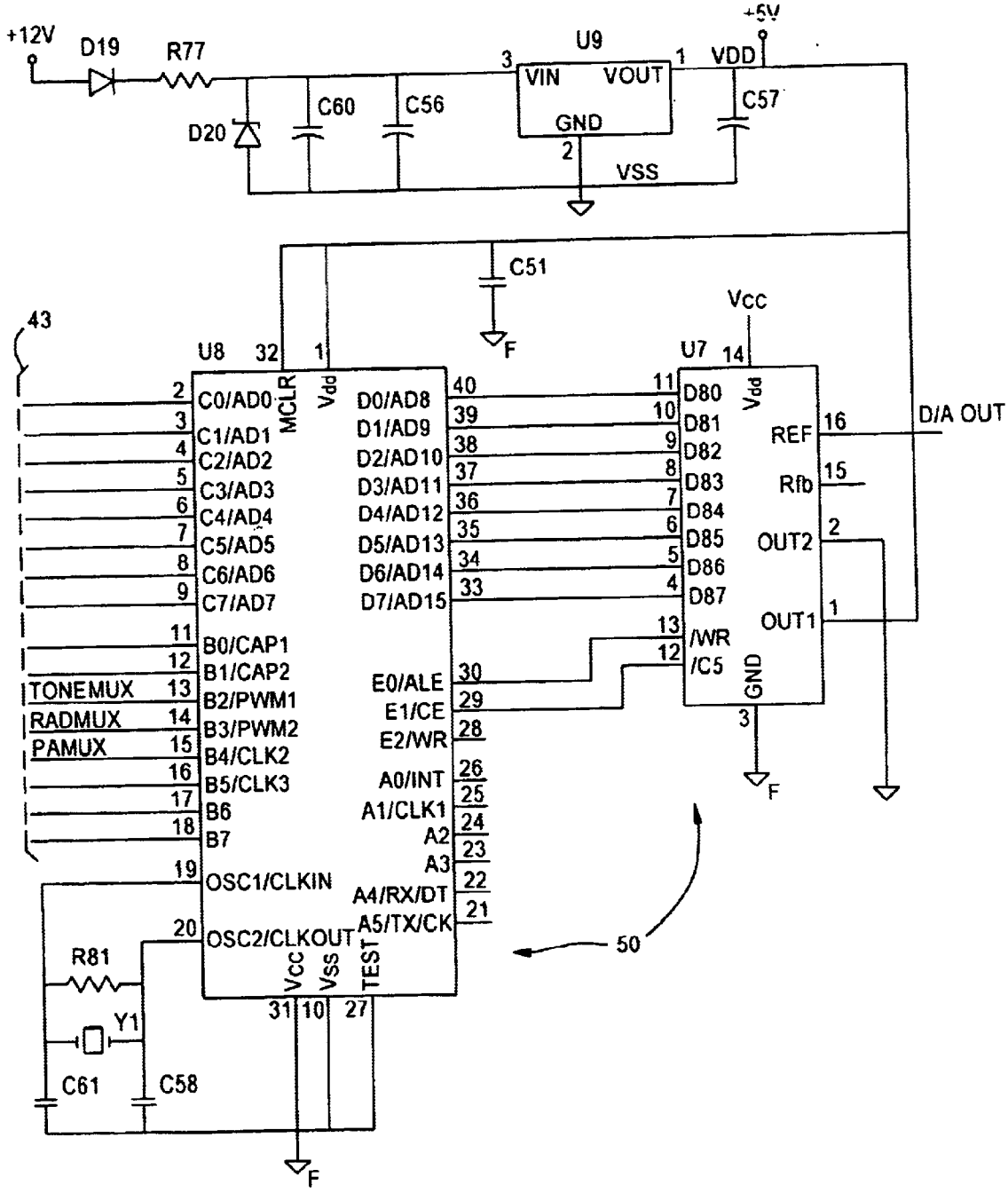
FIG. 5 is an enlarged schematic diagram of a micro controller and digital to analog converter for the electronic siren of FIG. 1.

With reference to FIG. 5 the micro control circuit 50 includes a voltage regulator U9, a micro controller U8 and a D/A converter U7. The voltage regulator U9 is used to provide regulated 5 VDC power to components of the electronic siren.

The micro controller U8 includes a microprocessor, 8 kilo bytes of EPROM for storing the operational instructions (program/algorithm) and 454 bytes of RAM memory for data storage. The microprocessor uses a program including a dynamic algorithm to create a digital output that is processed and amplified, resulting in a sound output closely resembling the sound of a mechanical siren. The digital output is not based on a recording or any actual data corresponding to the sound of a mechanical siren. The micro controller U8 assembles the sound pattern "on the fly" according to instructions and look-up tables that have been modified to result in the desired sound. In effect, the sound of a mechanical siren has been reverse engineered.

Figure 16:
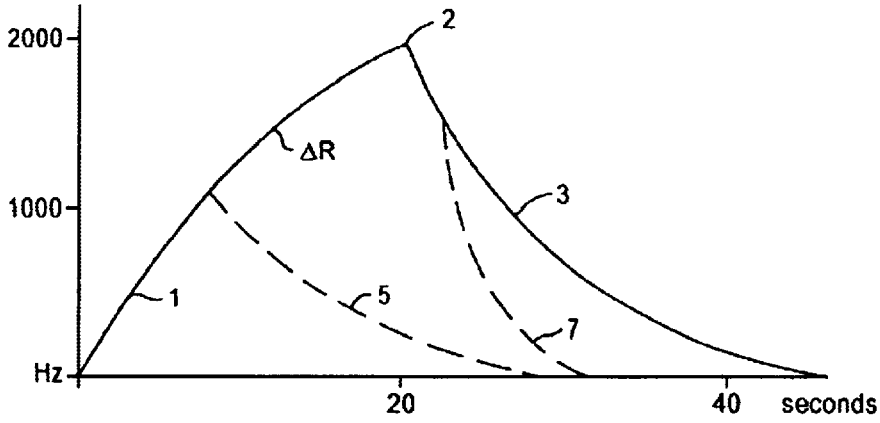
FIG. 16 is a graphical representation of frequency with respect to time for a hypothetical mechanical siren.

Before examining the operation of the dynamic algorithm, it may be useful to examine the sound pattern produced by a mechanical siren with reference to FIGS. 16 and 16A–16C. FIG. 16 graphically illustrates the sound frequency of a hypothetical mechanical siren with respect to time. The sound frequency starts low, ramps up to a maximum frequency of approximately 2 kHz and, when power is removed, ramps down again. It can be seen that the slope, or Δf of the ramp up and ramp down sides of the curve are different. It can also be seen that the rate of frequency change with respect to time Δf is variable along the curve. Alternative curve 5 illustrates a possible result of removing power before maximum frequency has been achieved. Alternative curve 7 illustrates a possible result of application of the brake during ramp down of the siren.

Figure 16A:
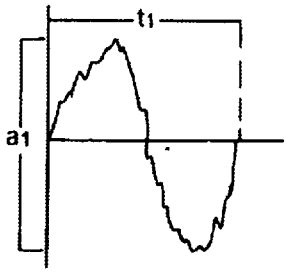
FIG. 16A is a graphical illustration of a representative sound wave produced by the hypothetical mechanical siren at point 1 on the curve of FIG. 16.

FIG. 16A illustrates a hypothetical sound wave produced at point 1 on the ramp up side of the curve of FIG. 16. The sound produced by the siren at this point has an amplitude $a_1$ and a frequency $f_1$. Frequency $f_1$ is approximately 500 Hz, resulting in a cycle time or period of approximately 0.002 seconds. The sound wave illustrated in FIG. 16A is not a neat sine wave. Most sounds are the result of the random interaction of multiple smaller parts, or harmonics. When combined, the resulting sound wave is often extremely complex. Many electronic devices produce very uniform or "clean" sounds that are easily differentiated from non-uniform, or "natural" sounds.

Figure 16B:
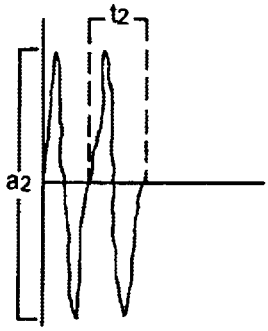
FIG. 16B is a graphical illustration of a representative sound wave produced by the hypothetical mechanical siren at point 2 on the curve of FIG. 16.

FIG. 16B illustrates a hypothetical sound wave produced at point 2, or peak frequency of the curve of FIG. 16. The wave has an amplitude $a_2$ and a frequency $f_2$ of approximately 2 kHz. The cycle time of this wave is approximately 0.0005 seconds. It should be noted that the amplitude $a_2$ of the siren sound is greater at 2 kHz than it was at 500 Hz. Study of mechanical sirens reveals that the amplitude (sound pressure dB) of the sound waves produced varies with the frequency of the sound.

Figure 16C:
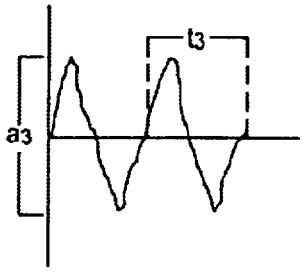
FIG. 16C is a graphical illustration of a representative sound wave produced by the hypothetical mechanical siren at point 3 on the curve of FIG. 16.

FIG. 16C illustrates a hypothetical sound wave produced at point 3 on the ramp down side of the curve of FIG. 16. The wave has an amplitude $a_3$ and a frequency $f_3$ of approximately 1 kHz, resulting in a cycle time of approximately 0.001 seconds. It should be noted that the amplitude $a_3$ is less than either $a_1$ or $a_2$. This is because the amplitude of the sound produced by a mechanical siren varies differently with respect to frequency on the ramp down side of the curve than it does on the ramp up side of the curve. As a result, the amplitude of a wave produced on the ramp down side of the curve may be different than the amplitude of a wave of the same frequency produced on the ramp up side of the curve.

In sum, an examination of sounds produced by mechanical devices, and mechanical sirens in particular, reveals the following:

1. The sounds produced are complex and have a harmonic content that is easily distinguished by the human ear from the uniform sounds typically produced by electronic devices;
2. The frequency of the sound produced by a mechanical siren varies with respect to time and further, the frequency of the sound produced varies differently with respect to time on the ramp up side of the frequency curve than on the ramp down side of the frequency curve; and
3. The amplitude of the sound produced by a mechanical siren varies with respect to the frequency of the sound and further, the amplitude of the sound produced varies differently with respect to the frequency of the sound produced on the ramp up side of the frequency curve than on the ramp down side of the frequency curve.

The software installed in the electronic siren incorporates these three concepts into a dynamic algorithm that creates a digital pattern which, when amplified, sounds to the human ear like a mechanical siren, i.e., the harmonic content and the rising and falling pitch pattern with respect to time. The electronic siren can also mimic the effect of a mechanical brake.

Figure 11:
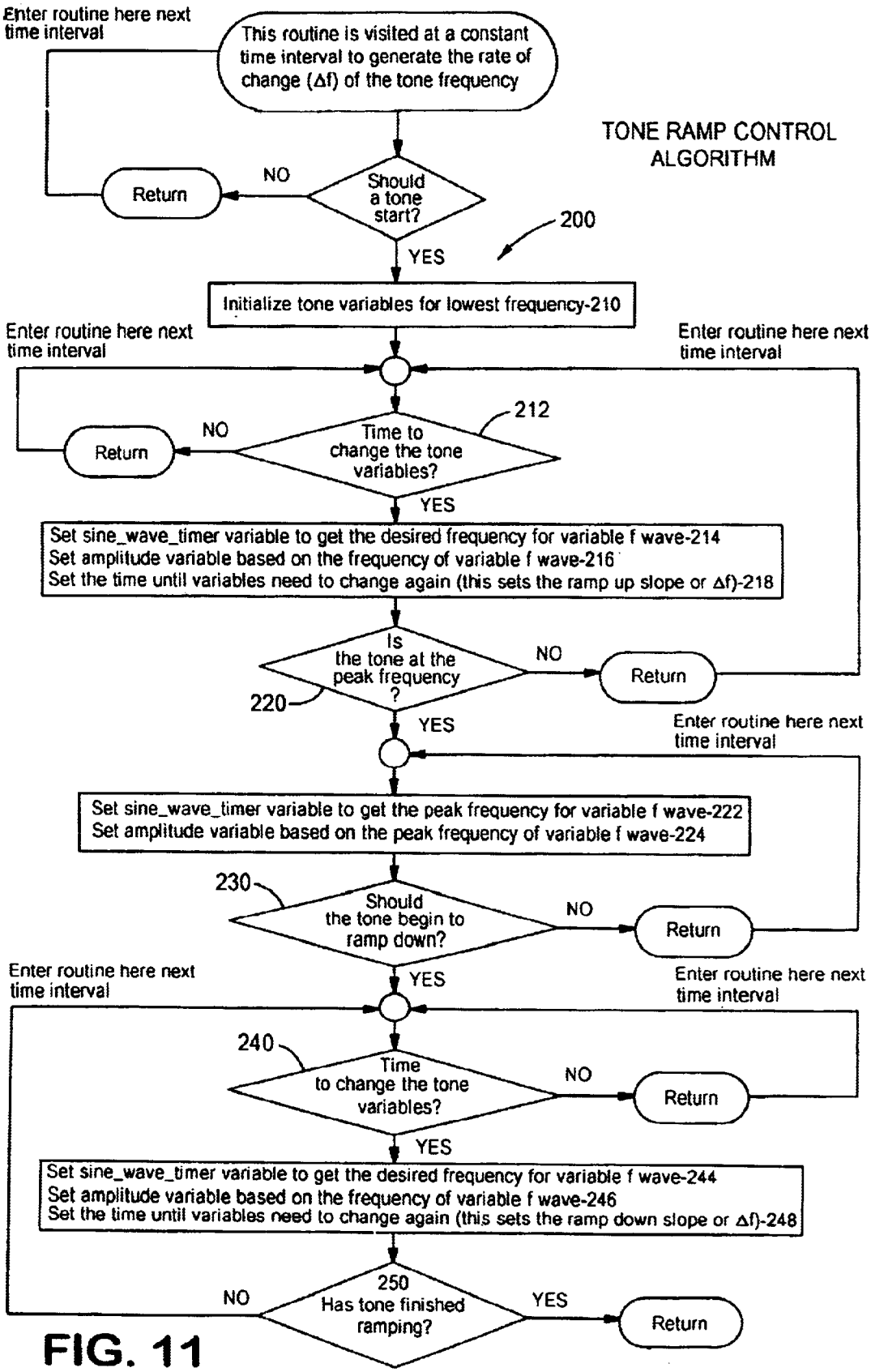
FIG. 11 is a flowchart of a portion of the program used by the micro controller of FIG. 6.
Figure 11A:
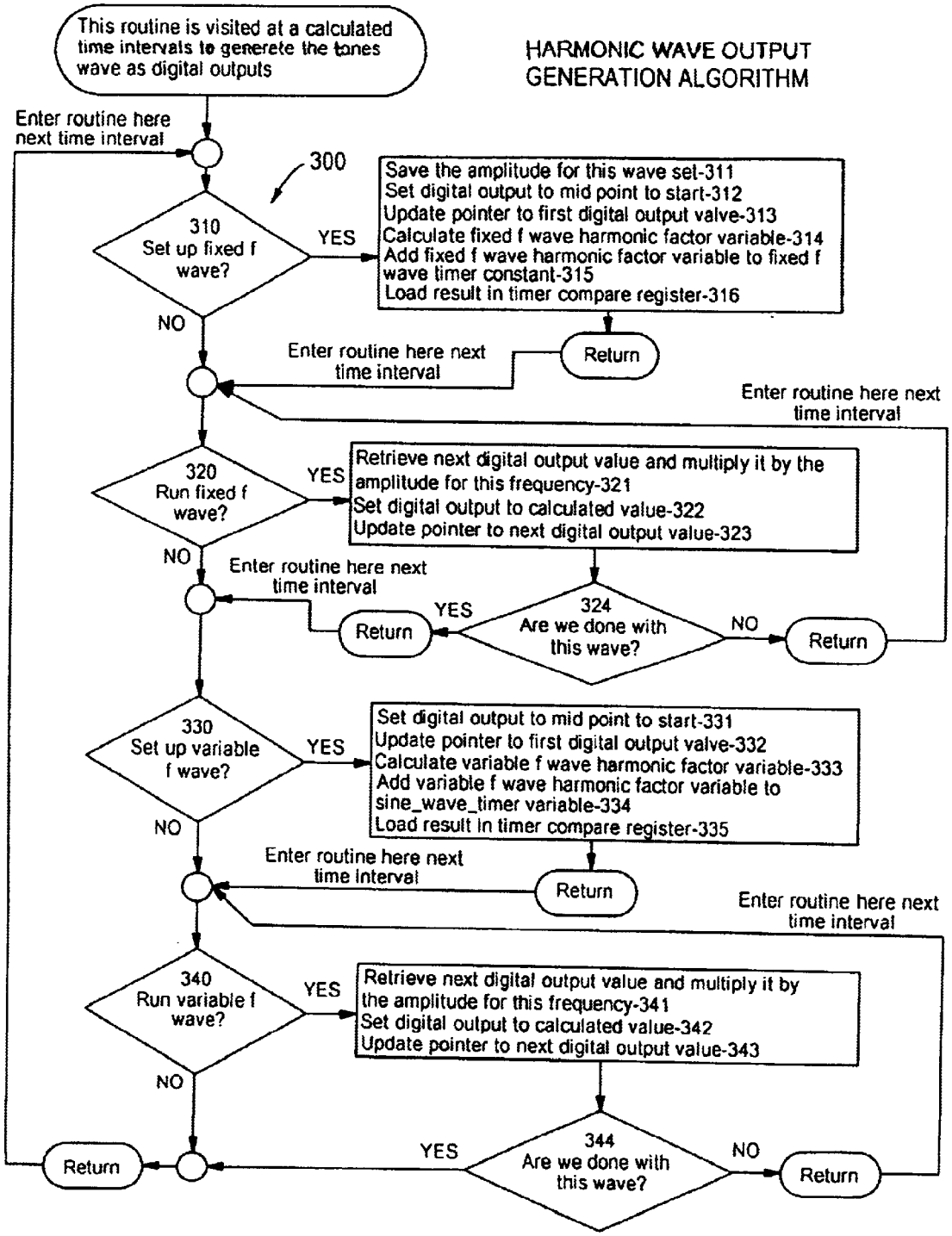
FIG. 11A is a flowchart of another portion of the program used by the micro controller of FIG. 6.

With reference to FIGS. 11 and 11A, the algorithm uses timers, a sine wave model and look up tables to create two waves, one having a substantially fixed frequency of approximately 1.666 kHz (fixed f wave) and the other (variable f wave) having a frequency that varies according to a mathematical model represented by values in two different sets of look up tables. Because we know that the Δf pattern is different for ramp up and ramp down, one table is needed to represent ramp up and another is needed to represent ramp down. The amplitude of both waves are varied according to a mathematical model also represented in two different look up tables, one for ramp up and one for ramp down. The waveforms are output from the micro controller in series, one after the other.

Figure 12:
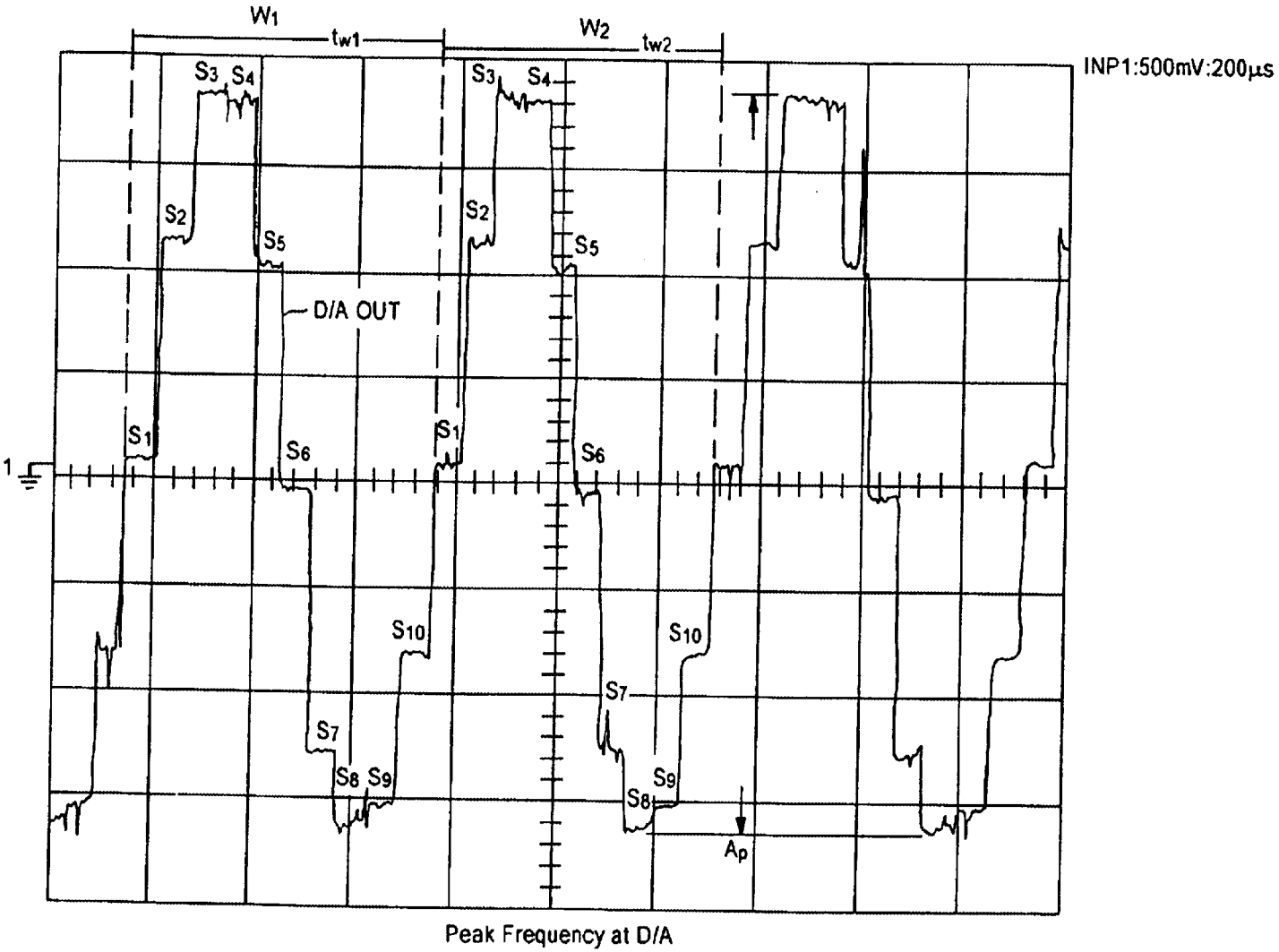
FIG. 12 is an oscilloscope image of a peak frequency output waveform at the D/A converter of FIG. 6.
Figure 14:
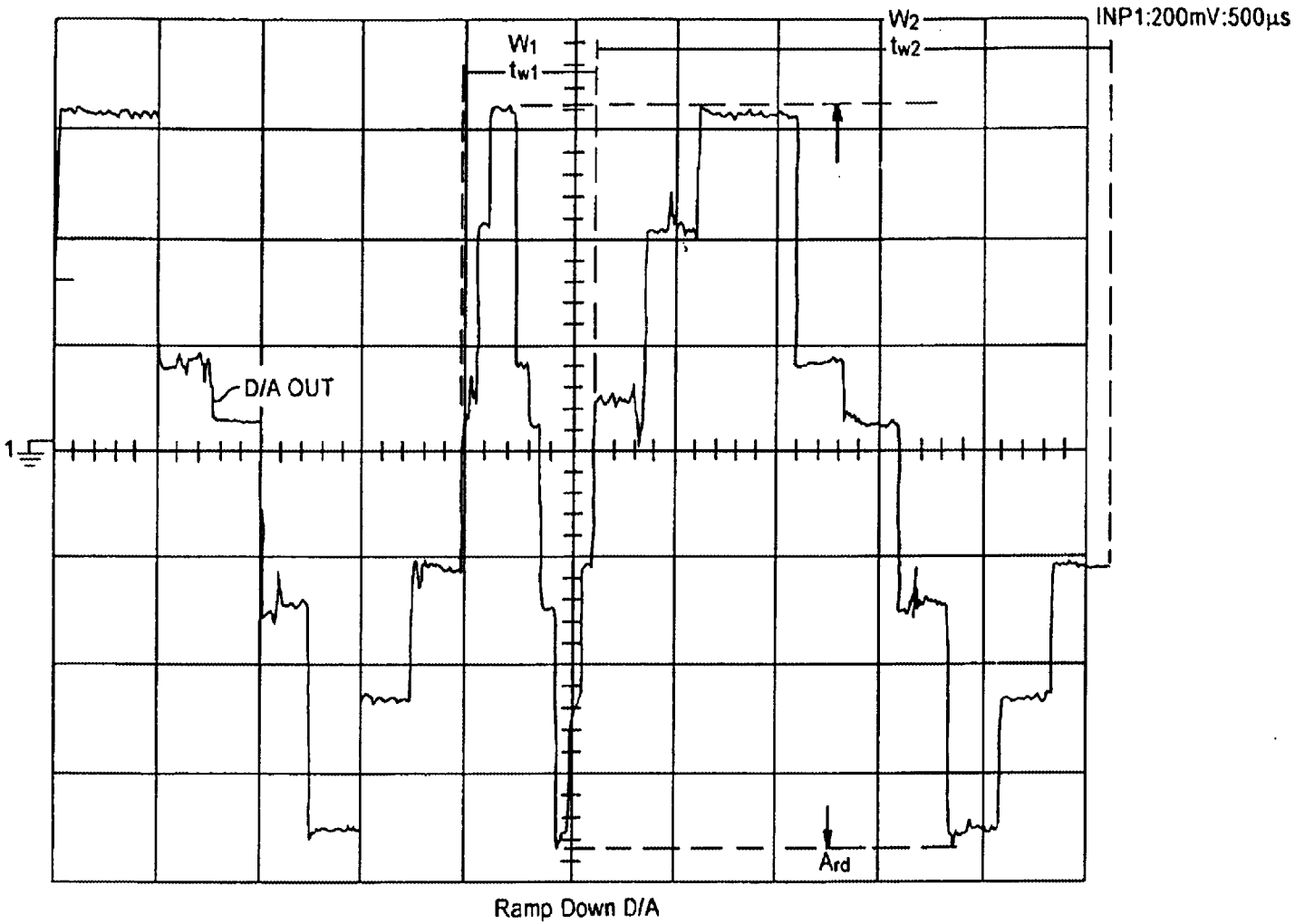
FIG. 14 is an oscilloscope image of a ramping down output waveform at the D/A converter of FIG. 6.

Each wave cycle (one wavelength) is created by the software in 10 equal-size segments. The stepped form of the waves is best seen in FIGS. 12 and 14. FIG. 12 illustrates the output from the D/A converter at peak siren frequency. Fixed f wave $W_1$ has a cycle time $t_{w1}$ of approximately 600 μsec and a frequency of approximately 1.666 kHz. Variable f wave $W_2$ has a cycle time $t_{w2}$ of approximately 540 μsec and a frequency of approximately 1.850 kHz. Each wave cycle is created from a series of 10 digital output values that are converted by the D/A converter into the stepped waveforms appearing in the figure. Each converted digital output value results in a waveform segment $S_1$–$S_{10}$. At the peak siren frequency the frequency of the fixed f wave and variable f wave are nearly identical.

In contrast, FIG. 14 illustrates the output of the D/A converter at a particular point during ramp down. Fixed f wave $W_1$ continues to have a cycle time $t_{w1}$ of 600 μsec and a frequency of approximately 1.666 kHz. Variable f wave $W_2$ now has a cycle time of approximately 2.5 msec and a frequency of approximately 400 Hz. It should be noted that the amplitude of fixed f wave $W_1$ is substantially equal to the amplitude of variable f wave $W_2$ throughout the frequency range. However, it can be seen that the amplitude of the waves varies with frequency. At peak frequency the waves have an amplitude $A_p$ at the D/A converter of approximately 3.5 volts peak to peak as seen in FIG. 12. FIG. 14 shows that, at the moment captured in the image, the waves have an amplitude $A_{rd}$ during ramp down of approximately 1.4 volts peak to peak.

The algorithm steps are partially illustrated in FIGS. 11 and 11A. FIG. 11 illustrates a tone ramp control algorithm 200 for calculating Δf and amplitude during ramp up and ramp down of the siren frequency. At step 210, the algorithm initializes the tone variables (sine_wave_timer variable and amplitude variable) for the lowest frequency. The sine_wave_timer variable determines the frequency of the variable f wave, while the amplitude variable determines the amplitude for both the variable f wave and the fixed f wave. The micro controller consults a slope counter inside of a timer interrupt routine at a constant time interval to determine when it is time to change the tone variables (step 212 "yes"). A sine_wave_timer variable is calculated at step 214 to achieve the desired frequency for the variable f wave. An amplitude variable is determined at step 216 from a look up table based on the ramp up frequency of the variable f wave. In step 218 the slope counter is loaded with a number that determines when the program will execute steps 214–218 again. A smaller number produces a steep slope while a larger number produces a gradual slope. This number is selected from slope look up tables containing values selected to produce an output sound corresponding to the ramp up and ramp down of a mechanical siren.

Steps 212–218 are repeated as long as the answer to the question at step 220 is no. When the answer to the question at step 220 is yes, the sine_wave_timer and amplitude variables are set to the values corresponding to the peak frequency of the variable f wave (steps 222, 224). Note that the slope counter of step 218 is no longer updated because the time interval will remain constant as long as the peak frequency tone is requested. The peak frequency is requested by answering the question of step 230 with a no, causing steps 222 and 224 to be repeated.

If the answer to the question of step 230 is yes, a ramp down sequence is begun involving steps 240–250 that parallel the steps 210–220 of the ramp up sequence just described. When it is time to change the tone variables (the answer to the question of step 240 is yes), step 244 calculates the sine_wave_timer variable to determine the next frequency for the variable f wave. Step 246 consults a ramp down amplitude look up table to determine the ramp down amplitude corresponding to the frequency determined in step 244. Step 248 consults the ramp down slope look up table for the next value to load in the slope counter. The values loaded in step 248 determine the ramp down slope or $\Delta f$ of the siren sound. Steps 240–248 repeat until the lowest siren tone is reached.

FIG. 11A illustrates the algorithm 300 used by the micro controller to build each wave set. Each wave set includes one fixed f wave and one variable f wave ($W_1$, $W_2$ of FIG. 12, respectively). If the answer to step 310 is yes, the algorithm executes steps 311–316 to set up the fixed f wave. Step 311 gets the amplitude determined by the tone ramp control algorithm (FIG. 11, step 216 or 246) and saves the value for use in the construction of both the fixed f wave and the variable f wave in the set. Step 312 sets the digital output to a mid point value for the start of the fixed wave (FIG. 12, W1, $S_1$). Step 313 moves a pointer on the sine wave model to the first digital output value.

Step 314 calculates the fixed f wave harmonic factor variable. Experimentation revealed that the resulting siren sound was more realistic if the width of the segments ($S_1$–$S_{10}$) of the fixed f and variable f waves are varied according to a different, constantly changing "harmonic factor variable". This "harmonic factor variable" is a whole number from 1–10 for the fixed f wave and from 1–22 for the variable f wave. The fixed f wave harmonic factor variable is calculated by incrementing the factor by one each time step 314 is performed. When the maximum value is reached, i.e., 10 for fixed f wave, the value is reset to zero. Once the fixed f wave harmonic factor variable has been determined, it is added to the fixed f wave timer constant (step 315) and the result loaded into a timer compare register (step 316). The value in this timer compare register determines the duration of each segment of the fixed f wave for this wave set ($W_1$, $S_1$–$S_{10}$ of FIG. 12).

Once the parameters of the initial segment $S_1$ of the fixed f wave have been established in steps 311–316, the wave is "run" in steps 320–324. When the answer to the question "run fixed f wave?" (step 320) is yes, the algorithm retrieves the digital output value established in step 313 and multiplies it by the amplitude saved in step 311. This product is set as the digital output of the micro controller, i.e., an 8 bit digital "word" on output lines D0–D7 (FIG. 5, U8). Step 323 increments the pointer on the sine wave model to the next digital output value. The algorithm answers the question "are we done with this wave?" (step 324) "no" 9 times, repeating steps 321 through 323 for a total of ten times. Each of the 10 repetitions of steps 321–323 producing a digital output corresponding to each of the 10 segments $S_1$–$S_{10}$ seen in FIG. 12. The tenth visit to step 324 produces a "yes" response, and the algorithm moves on to setting up and running the variable f wave for the wave set.

The set up of the variable f wave in steps 330–335 is the same as the set up of the fixed f wave in steps 311–316 except the algorithm uses the sine_wave_timer variable from the tone ramp control algorithm 200 and a different harmonic factor variable and calculation. The sine_wave_timer variable from the tone ramp control algorithm varies according to where the siren sound is on the ramp up ramp down frequency curve of FIG. 16. The variable f wave harmonic factor variable has a range from 0–22 and is incremented by 2 each time step 333 is performed. When the maximum value of 22 is reached, the value is reset to zero. The variable f wave harmonic factor variable and the sine_wave_timer variable are added and the result is loaded into a timer compare register (step 335). The value in this timer compare register determines the duration of each segment of the variable f wave for this wave set ($W_2$, $S_1$–$S_{10}$, FIG. 12).

Steps 340–344 are repeated 9 additional times to form the complete variable f wave at the digital output of the micro controller. The tenth visit to step 344 results in a "yes" response that returns the algorithm to step 310 to produce the next wave set. Steps 310–324 use the same amplitude as steps 330–344, resulting in a wave set in which the amplitude of the fixed f wave and the variable f wave are the same. However, each new wave set will update the amplitude variable and the sine_wave_timer values to reflect the changes occurring in the parallel tone ramp control algorithm 200.

It should be emphasized that the harmonic factor variables (fixed f wave and variable f wave) are always very small with respect to the number it is added to (fixed f wave timer constant or sine_wave_timer variable). Therefore, the resulting variations in frequency of the fixed f wave and the variable f wave are not easily measured or observed except by the human ear. It should be also be noted that each of the harmonic factor variables is calculated independently, using different variable ranges and methods of calculation. This arrangement results in a small cyclical variation of the frequency of each of the waves and a random variation of the frequency of the waves with respect to each other. These relationships have proven to result in a siren sound pattern closely emulating the complex harmonic content of a mechanical siren. This is significant because it is known in the art that the "edginess" of a mechanical siren is better at getting the attention of motorists and pedestrians than a "clean" or uniform electronically produced sound.

Other sounds use simpler algorithms and data in a similar manner. Since tones or yelps are much less complex than the mechanical siren, these sounds require less complex algorithms and data tables.

The sound patterns leave the micro controller U8 on output lines D0–D7 in the form of 8 bit digital "words". The D/A converter U7 converts the digital "words" into a stepped analog waveform D/A OUT illustrated in FIGS. 12 and 14. While an integrated circuit U7 is illustrated for the purpose of D/A conversion, one of ordinary skill in the art would understand that this function can be performed by an appropriately configured resistance ladder network (not illustrated) as is known in the art.

Figure 7:
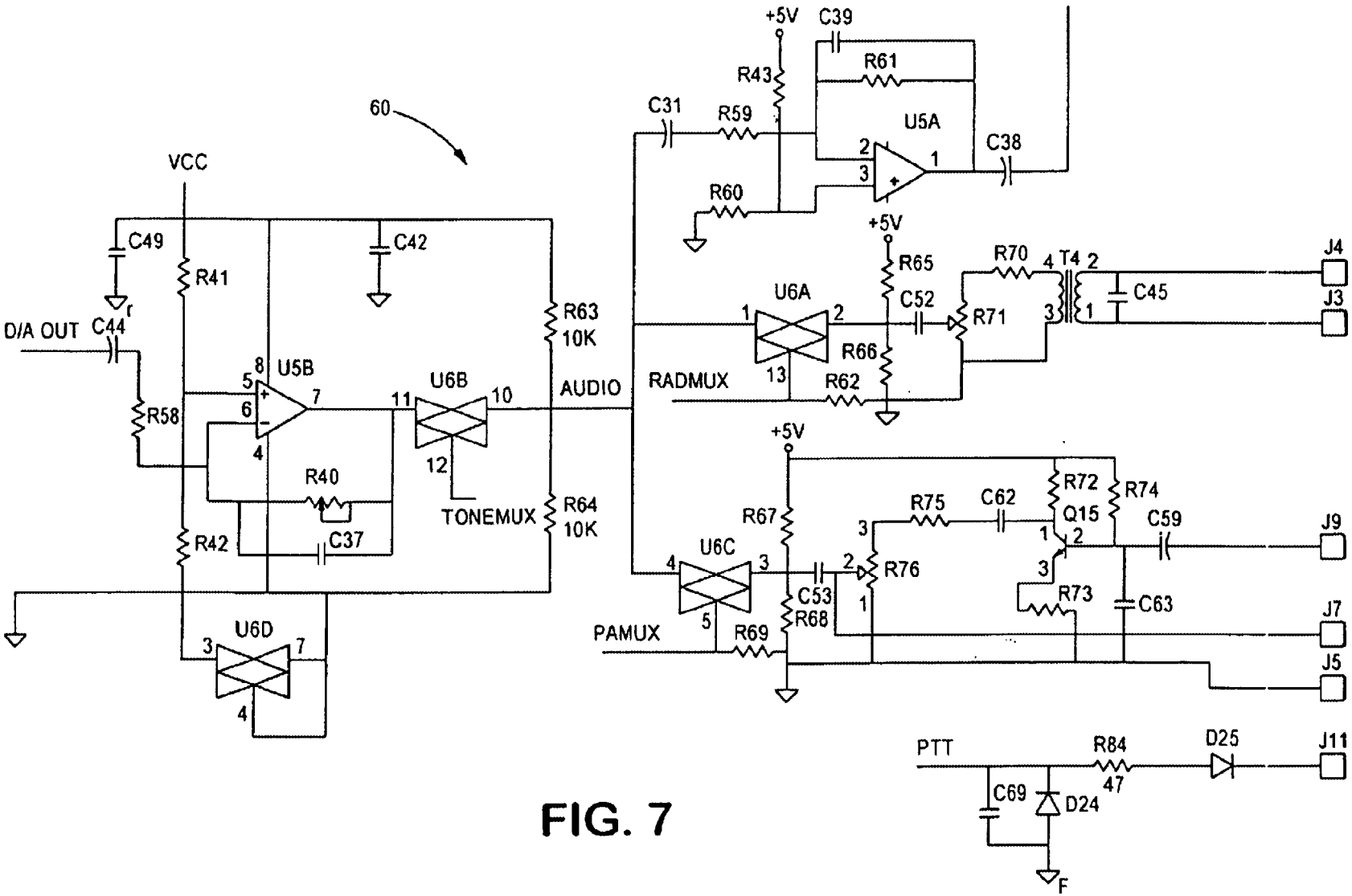
FIG. 7 is an enlarged schematic diagram of the audio-conditioning circuit for the electronic siren of FIG. 1.

With reference to FIG. 7 the audio conditioning circuit 60 is configured to receive the D/A OUT waveform from the D/A converter as well as signals from the radio and microphone and a signal that are not generated by the microprocessor. Each signal path is provided with a variable resistor R71, R76 and R40 to provide level control so that all signals leave the audio conditioning circuit 60 at substantially the same amplitude. Each analog multiplexer turns on in responsive to a signal from the micro controller U8. Signal TONEMUX allows the D/A OUT signal to pass through multiplexer U6B. Signals RADMUX and PAMUX turn on multiplexers U6A and U6C respectively. This arrangement ensures that only one signal at a time leaves the audio conditioning circuit 60 as the signal AUDIO.

The audio conditioning circuit filters the D/A OUT signal through capacitor C37 to smooth the stepped shape of the waveform. Operational amplifier U5B and variable resistor R40 provide level control for the D/A OUT signal. The conditioned signals leave the audio conditioning circuit as AUDIO and are applied as an input to the audio amplifier 100.

Figure 8:
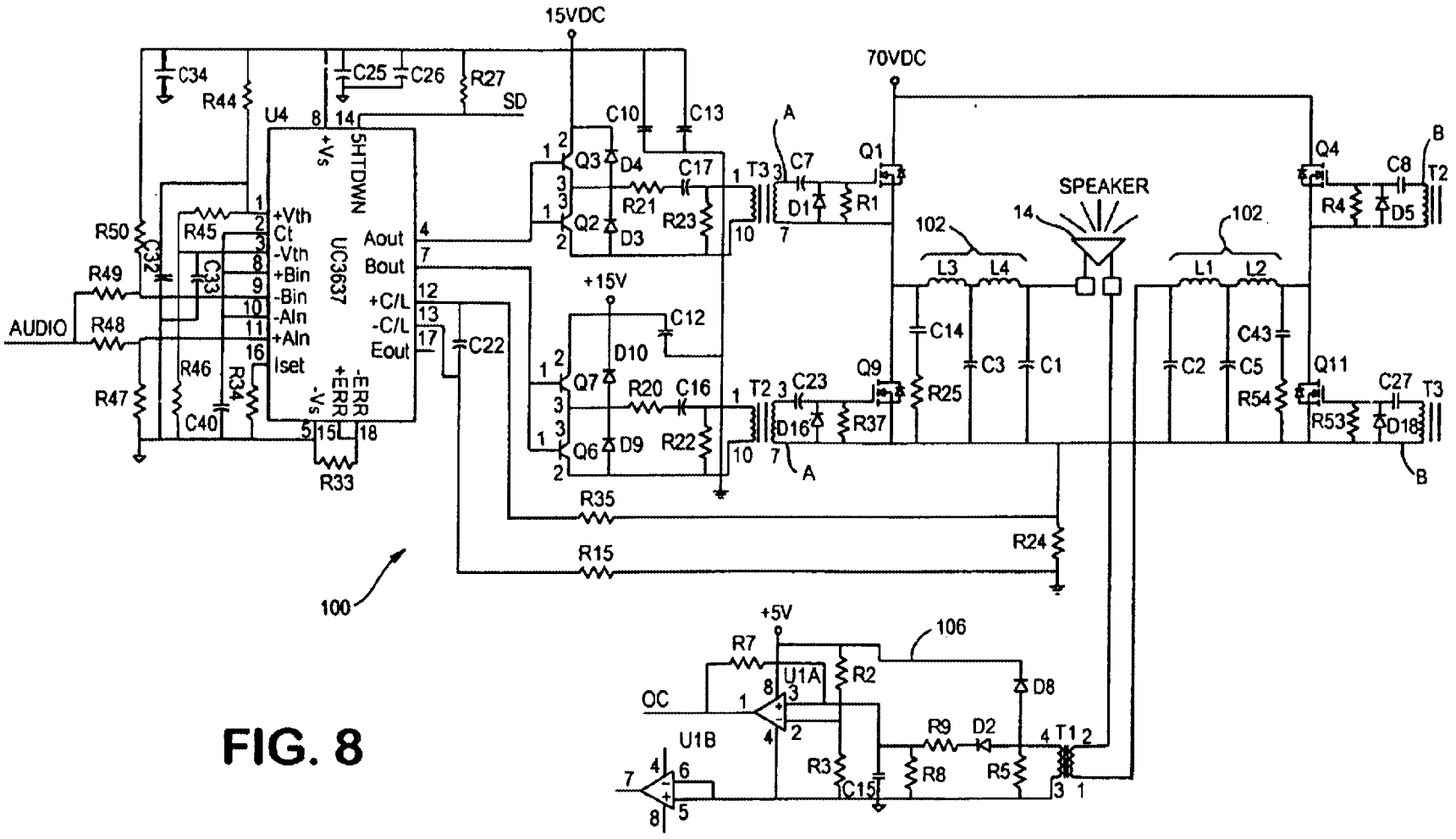
FIG. 8 is an enlarged schematic diagram of the audio amplifier for the electronic siren of FIG. 1.
Figure 9:
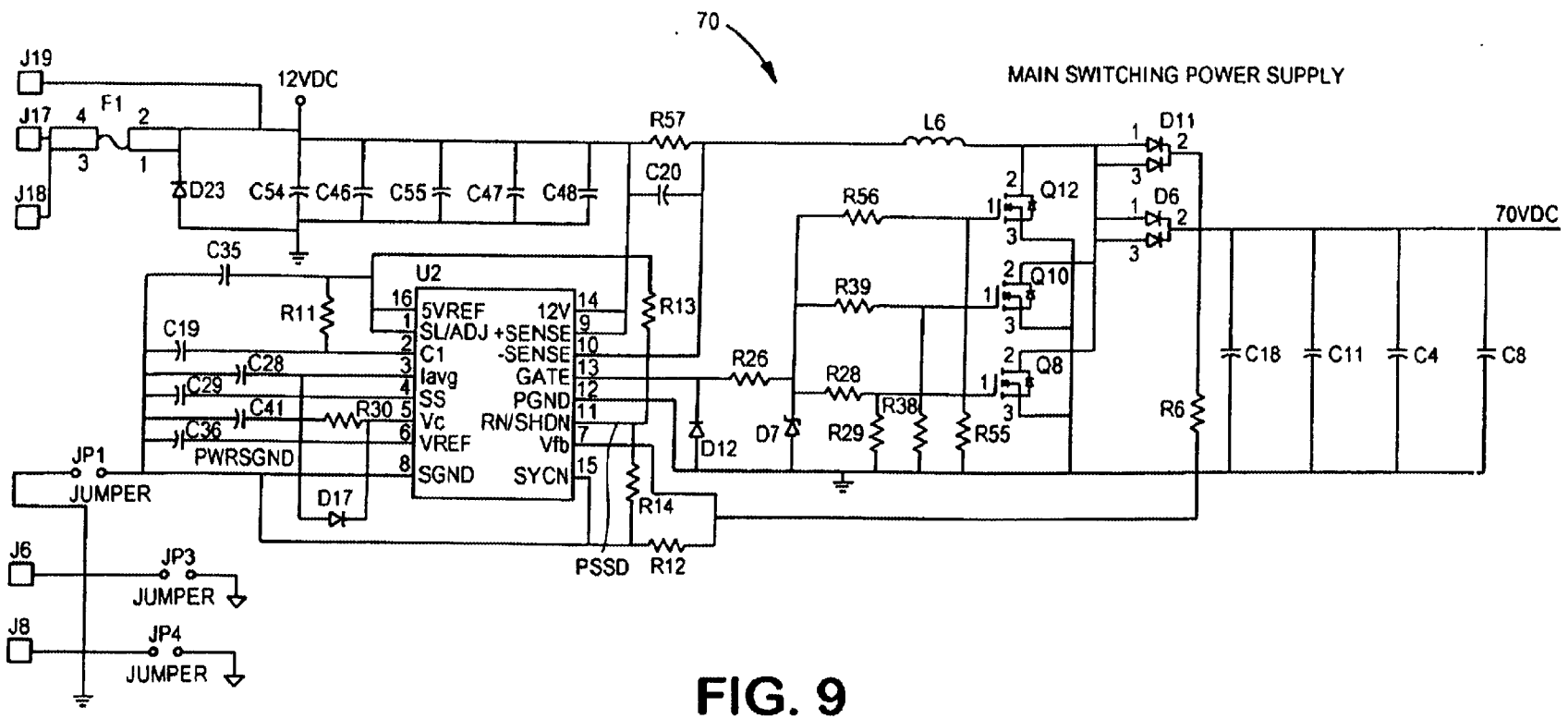
FIG. 9 is an enlarged schematic diagram of the main switching power supply for the electronic siren of FIG. 1.
Figure 10:
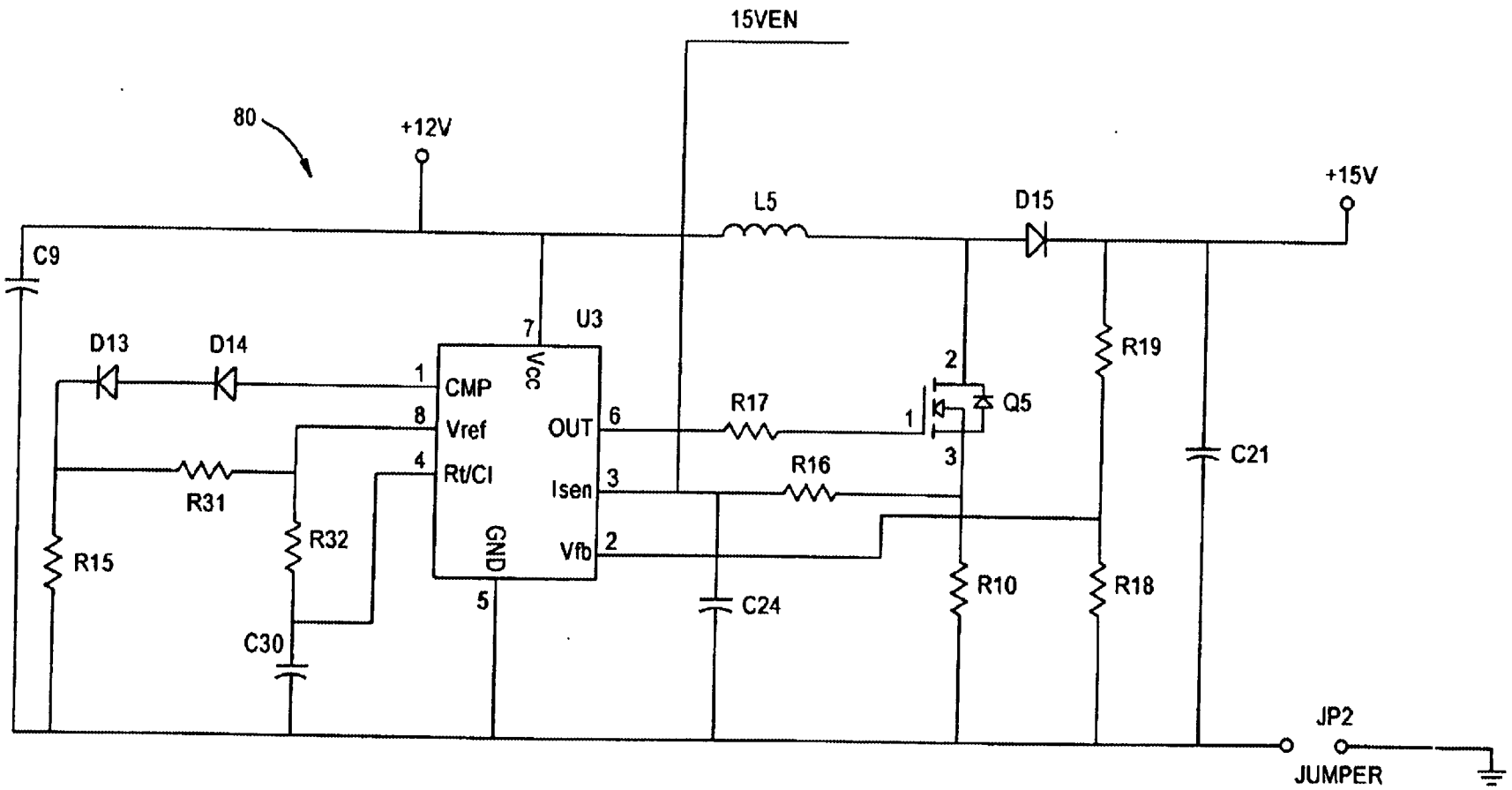
FIG. 10 is an enlarged schematic diagram of the power supply for the electronic siren of FIG. 1.

With reference to FIG. 8, the audio amplifier 100 is preferably a class D amplifier. A class D amplifier is a non-linear amplifier in which the active devices (in this case output stage MOSFETs Q1, Q4, Q9, Q11) operate as "switches". The active devices are either off (not conducting) or full on (conducting). Because active devices are most efficient when full on, class D amplifiers have efficiencies approaching or exceeding 90%. In other words, 90% of the power used by the amplifier is output to the load (in this case a speaker). Class A and class AB amplifiers have efficiencies rarely exceeding 50%. As a result, the electronic siren 10 can produce high sound pressures using a much smaller current than conventional amplifiers. An additional benefit of low power consumption is that the class D amplifier produces a fraction of the heat expected from a Class A or AB amplifier of equivalent power.

A class D amplifier works on the principle of pulse width modulation (PWM). Essentially, the output of a class D amplifier is a square wave in which the width of each wave or pulse is proportional to the amplitude of the corresponding audio signal. A low pass filter is used to demodulate the pulses into an amplified audio signal for a speaker. The low pass filter passes the time average value of the pulses in the audio band (20 kHz or below), producing a voltage across the load (speaker) proportional to the instantaneous value of the original incoming audio signal.

The audio amplifier 100 includes an amplifier controller U4 which receives the AUDIO signal. The amplifier controller U4 has an internal clock operating at a frequency of 100 kHz. The amplifier controller U4 is responsive to the AUDIO signal to produce a width modulated square wave in which the width of the square wave pulses are proportional to the amplitude of the AUDIO signal.

The AUDIO signal is a complex sine wave of varying frequency and amplitude. The AUDIO signal rises above (positive) and falls below (negative) an average value or zero line. The frequency of the AUDIO signal is reflected in the rapidity with which the signal changes from positive to negative and back again. The amplifier controller U4 produces a width modulated square wave corresponding to the positive and negative parts of the audio signal. The resulting square waves have a constant amplitude but variable width or duty cycle, with large amplitude portions of the audio signal producing wide square waves and small amplitude portions of the audio signal producing narrow width square waves as is known in the art.

The width modulated square wave corresponding to the positive part of the audio signal is then used to switch a push-pull coupled pair of transistors Q2, Q3 on and off with the on time for the transistors corresponding to the width of the square wave fed to the base of the transistors. The resulting current flow through the coupled transistors represents an amplified version of the width modulated square wave. The coupled transistors Q2, Q3 cooperate to induce a current flow in the primary winding of transformer T3.

The negative part of the AUDIO signal is identically processed and amplified through an identical pair of push-pull coupled transistors Q6, Q7 to induce a corresponding current flow in the primary winding of transformer T2.

Transformers T2 and T3 are substantially identical. Each transformer T3, T2 has two secondary windings magnetically coupled to the primary winding so that current in the primary winding induces a corresponding current in the secondary windings. The secondary windings of each transformer are also identical so that the current induced in secondary winding A is the same as the current induced in secondary winding B.

The output stage of the audio amplifier is an H bridge arrangement of four MOSFETs Q1, Q4, Q9, Q11 as illustrated in FIG. 8. The speaker 14 is connected between the two pairs of MOSFETs. In this arrangement, diagonally opposed pairs of MOSFETs, i.e., Q1 and Q11, Q4 and Q9 cooperate to produce voltage across the speaker through a two stage low pass filter 102. The gates of each diagonally opposed MOSFET pair receives their input signal from the secondary windings A, B of the same transformer. Each diagonally opposed MOSFET pair are simultaneously turned on and off in a pattern corresponding to the amplified width modulated square wave output of one of the coupled transistor pairs Q2 and Q3 or Q6 and Q7.

Figure 13:
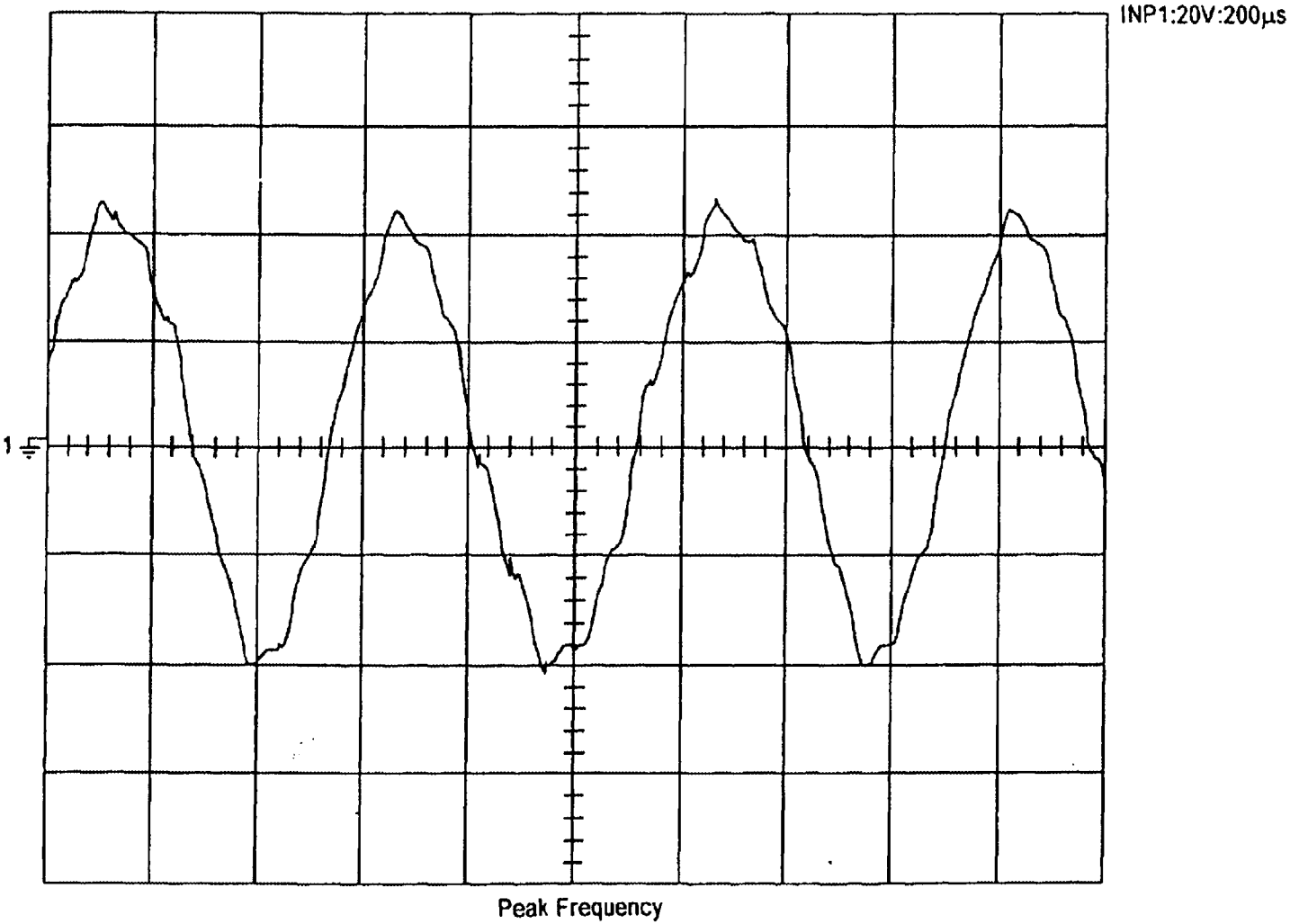
FIG. 13 is an oscilloscope image of a peak frequency output waveform of the audio amplifier of FIG. 9.
Figure 15:
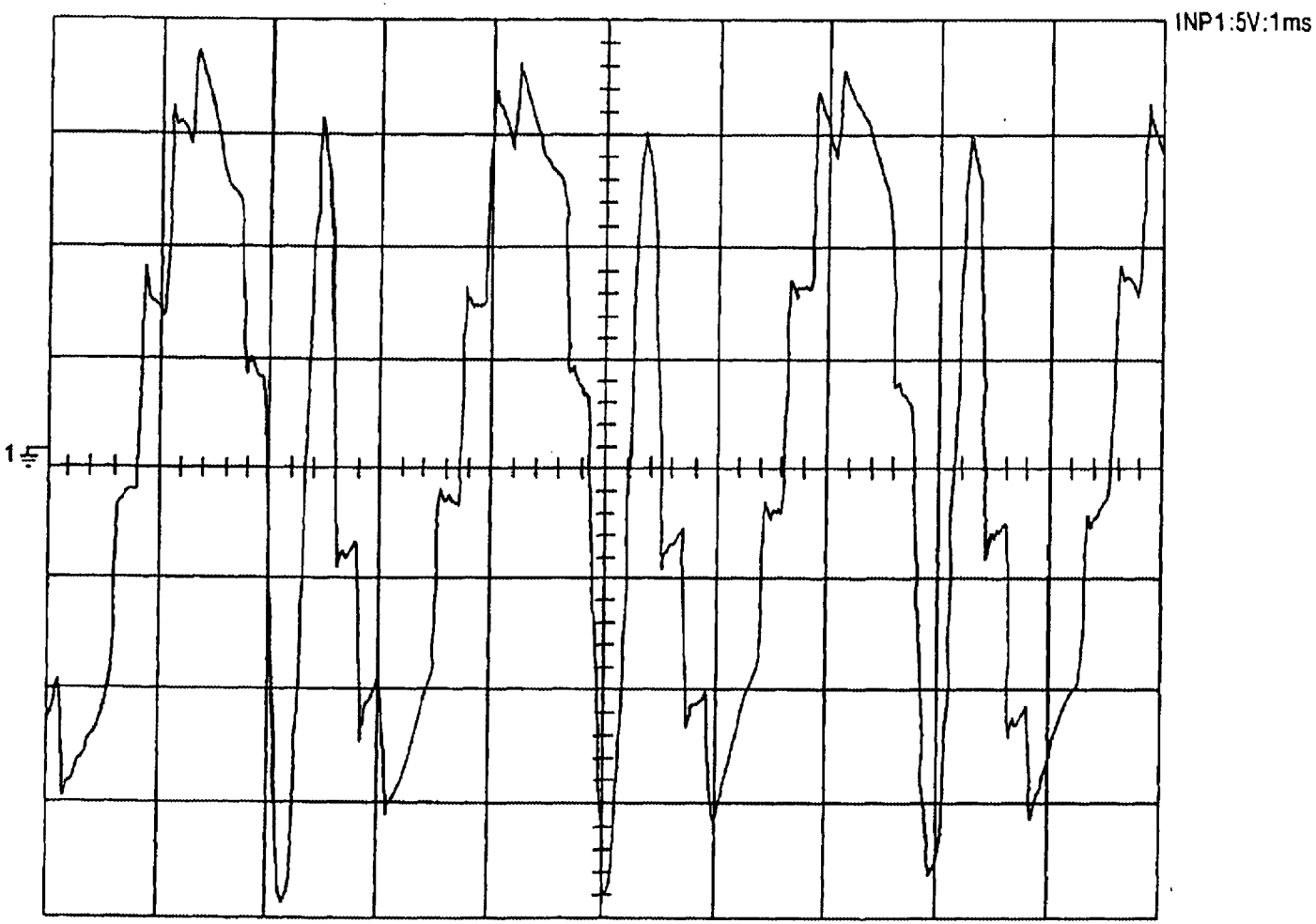
FIG. 15 is an oscilloscope image of a ramping down output waveform of the audio amplifier of FIG. 9.

The audio amplifier 100 is cooperatively interconnected with a switching power supply 70. The switching power supply 70 converts the vehicle 12 volt DC power into 70 VDC power as is known in the art. The 70 VDC is applied across the two diagonally opposed MOSFET pairs Q1/Q11, Q4/Q9. When a diagonally opposed pair of MOSFETs are triggered, 70 VDC power is available to be applied across the speaker and low pass filter arrangement. The pulses of 70 VDC are demodulated by the low pass filter into an amplified audio signal to drive the speaker. The amplified audio signal is illustrated in FIGS. 13 and 15.

A current sensing circuit 106 monitors current flow through the speaker 14. If excessive current is detected, the current sensing circuit generates an over current signal OC. The over current signal OC is applied through the circuit to the micro controller U8. The micro controller U8 shuts down the switching power supply 70, the audio amplifier 100 and the 15 volt power supply 80 by toggling signals PSSD, SD and 15 VEN, respectively.

While a preferred embodiment of the foregoing invention has been set forth for purposes of illustration, the foregoing description should not be deemed the limitation of the invention herein. Accordingly, various modifications, adaptations and alternatives may occur to one skilled in the art without departing from the spirit and the scope of the present invention.

What is claimed is:

1. An electronic siren comprising:

a command unit for selectively generating at least one command signal;

a microprocessor programmed with at least one algorithm;

a memory accessible by said microprocessor, said memory containing look up tables defining values used by said algorithm to emulate the frequency range, the rate of frequency change Δf and amplitudes as a function of frequency for at least a sweep up-down siren sound;

a class D amplifier which receives and amplifies a signal generated by said microprocessor; and a speaker operatively connected to said amplifier, wherein said microprocessor executes said algorithm in response to a said command signal and said algorithm utilizes said data to produce a series of digital outputs emulating said siren sound and said digital pattern is converted to an audio signal which is applied to said amplifier.

2. The electronic siren of claim 1, comprising a digital to analog converter, wherein said series of digital outputs are converted to an analog output.

3. The electronic siren of claim 1, wherein said algorithm emulates said siren sound by constructing a series of wave sets, each wave set including a fixed frequency wave and a variable frequency wave, said fixed frequency wave having a substantially constant frequency throughout the frequency range of said siren sound and said variable frequency wave having a frequency varied by said algorithm according to values in said look up tables.

4. The electronic siren of claim 3, wherein the frequency of said fixed frequency wave and the frequency of said variable frequency wave are altered by a small increment each time a wave set is generated, said fixed frequency wave altered by a different amount and according to a different formula than said variable frequency wave.

5. The electronic siren of claim 3, wherein the amplitude of said fixed frequency wave and said variable frequency wave in each wave set is substantially the same.

6. The electronic siren of claim 1, wherein said look up tables comprise two look up tables for Δf, a first Δf look up table corresponding to an increasing frequency portion of the siren sound and a second Δf look up table corresponding to a decreasing frequency portion of the siren sound.

7. The electronic siren of claim 1, wherein said look up tables comprise two look up tables for amplitude as a function of frequency, a first amplitude as a function of frequency look up table corresponding to frequencies on an increasing frequency portion of the siren sound and a second amplitude as a function of frequency look up table corresponding to frequencies on a decreasing frequency portion of the siren sound.

8. The electronic siren of claim 1, wherein said class D amplifier includes an H bridge output stage.

9. The electronic siren of claim 8, wherein said H bridge output stage includes MOSFET active devices.

10. The electronic siren of claim 1, comprising a switching power supply operatively configured to supply voltage to an output stage of said class D amplifier.

11. The electronic siren of claim 1, wherein said siren is capable of generating 126 dB of sound pressure at a distance of 10 feet from said speaker on a current draw of 10 amps.

12. The electronic siren of claim 1, wherein said memory includes algorithms for generating warning sounds in addition to said siren sound, said warning sounds including a yelp, bell, wail, hands free sequence.

13. The electronic siren of claim 1, comprising a microphone socket for installation of a microphone and components permitting amplification of signals generated by said microphone through said class D amplifier.

14. The electronic siren of claim 1, comprising components for receiving and amplifying a vehicle radio audio signal through said class D amplifier and said speaker.

15. The electronic siren of claim 1, comprising an input and an output EMI filter, wherein all signals passing in or out of said electronic siren pass through one of said input or output EMI filters.

16. A method for emulating a mechanical siren comprising the steps of:

storing at least one algorithm for emulating the sound pattern of a mechanical siren in memory accessible by a microprocessor, said algorithm comprising a plurality of look up tables defining values used by the algorithm to emulate:

the frequency range of the siren, the harmonic characteristics of the siren sound over said frequency range, and the relationship of frequency change with respect to time Δf for the siren sound over said frequency range, executing said algorithm to combine values from said look up tables to produce a train of digital outputs corresponding to the sound of the mechanical siren;

converting said digital output to an analog signal;

applying said analog signal to a class D amplifier to produce an amplified signal; and communicating said amplified signal to a speaker.

17. The method of claim 16, wherein said algorithm includes the steps of:

constructing a series of wave sets, each wave set including a fixed frequency wave and a variable frequency wave, said fixed frequency wave having a substantially constant frequency throughout the frequency range of said siren sound and said variable frequency wave having a frequency varied by said algorithm according to values in said look up tables.

18. The method of claim 16, wherein said algorithm comprises the step of:

altering the frequency of said fixed frequency wave and said variable frequency wave by a small increment each time a wave set is constructed, said fixed frequency wave altered by a different amount and according to a different formula than said variable frequency wave.

19. The method of claim 16, wherein said step of executing further comprises accessing look up tables comprising two look up tables for Δf, a first Δf look up table corresponding to an increasing frequency portion of the siren sound and a second Δf look up table corresponding to a decreasing frequency portion of the siren sound.

20. The method of claim 16, wherein said step of executing further comprises accessing look up tables comprising two look up tables for amplitude as a function of frequency, a first amplitude as a function of frequency look up table corresponding to frequencies on an increasing frequency portion of the siren sound and a second amplitude as a function of frequency look up table corresponding to frequencies on a decreasing frequency portion of the siren sound.

* * * * *